US009662903B2

(12) United States Patent
Cappello et al.

(10) Patent No.: US 9,662,903 B2
(45) Date of Patent: May 30, 2017

(54) INK-JET PRINTER FOR PRINTING ON CARDS

(75) Inventors: Paolo Cappello, Ivrea (IT); Corrado Fogato, Ivrea (IT); Norma Giordano, Arnad (IT); Baldassare Tringali, Ivrea (IT)

(73) Assignee: SICPA HOLDING SA, Prilly (CH)

( * ) Notice: Subject to any disclaimer, the term of this patent is extended or adjusted under 35 U.S.C. 154(b) by 333 days.

(21) Appl. No.: 13/977,359

(22) PCT Filed: Dec. 29, 2011

(86) PCT No.: PCT/IB2011/056001

§ 371 (c)(1),
(2), (4) Date: Oct. 10, 2013

(87) PCT Pub. No.: WO2012/090176

PCT Pub. Date: Jul. 5, 2012

(65) Prior Publication Data

US 2014/0043416 A1 Feb. 13, 2014

(30) Foreign Application Priority Data

Dec. 30, 2010 (IT) ..... MI2010A002478

(51) Int. Cl.
*B41J 11/00* (2006.01)
*B41J 3/407* (2006.01)
(Continued)

(52) U.S. Cl.
CPC ..... *B41J 11/0015* (2013.01); *B41J 3/407* (2013.01); *B41J 11/002* (2013.01); *B41J 11/02* (2013.01);
(Continued)

(58) Field of Classification Search
CPC ..... B41J 11/0015; B41J 13/12; B41J 11/002; B41J 3/407; B41J 11/02
(Continued)

(56) References Cited

U.S. PATENT DOCUMENTS 5,646,653 A * 7/1997 Fujioka ..... B41J 11/002 347/104
6,375,318 B1 * 4/2002 Johnson ..... B41J 11/0005 347/102
(Continued)

FOREIGN PATENT DOCUMENTS

CN 1898347 1/2007
EP 661870 A1 7/1995
(Continued)

OTHER PUBLICATIONS

China Office Action conducted in China Appln. No. 201180067489.9 (Nov. 2, 2014) (w/ partial English translation).
(Continued)

*Primary Examiner* — Henok Legesse
(74) *Attorney, Agent, or Firm* — Greenblum & Bernstein, P.L.C.

(57) ABSTRACT

An ink-jet printer for printing on a thermoplastic card includes a support on which the card is placed and a printing station includes at least one ink-jet printhead for printing on the card. A reservoir is coupled to the ink-jet printhead and contains an ink comprising: a medium consisting of a low-boiling organic solvent; an auxiliary solvent consisting of a high-boiling organic solvent; and a coloring component soluble in the medium. The support includes a heating system to heat the card during operation of the printing station.

17 Claims, 13 Drawing Sheets

(51) Int. Cl.

| | |
|---|---|
| ***B41J 11/02*** | (2006.01) |
| ***B41J 13/12*** | (2006.01) |
| *B41M 5/00* | (2006.01) |

(52) U.S. Cl.
CPC ..... *B41J 13/12* (2013.01); *B41M 5/0011* (2013.01); *B41M 5/0047* (2013.01); *B41M 5/0064* (2013.01)

(58) Field of Classification Search
USPC ..... 347/102, 101, 106, 17, 19
See application file for complete search history.

(56) References Cited

U.S. PATENT DOCUMENTS

| | | | | |
|---|---|---|---|---|
| 8,282,179 | B2 * | 10/2012 | Haraguchi | B41J 11/007 347/4 |
| 9,102,136 | B2 * | 8/2015 | Kambara | B41J 11/0085 |
| 2003/0024422 | A1 | 2/2003 | Pribula et al. | |
| 2005/0090579 | A1 | 4/2005 | Zhu et al. | |
| 2008/0018690 | A1 * | 1/2008 | Nishida | B41J 11/002 347/18 |
| 2009/0251522 | A1 | 10/2009 | Koike | |
| 2010/0053291 | A1 | 3/2010 | Yoda | |
| 2010/0239789 | A1 * | 9/2010 | Umeda | B29C 41/28 428/1.33 |
| 2012/0147080 | A1 * | 6/2012 | Kodaira | B41J 11/002 347/17 |
| 2013/0265359 | A1 * | 10/2013 | Sugaya | B41J 11/002 347/16 |

FOREIGN PATENT DOCUMENTS

| | | |
|---|---|---|
| JP | 06-155858 | 6/1994 |
| JP | 09-323405 | 12/1997 |
| JP | 2002-255131 | 9/2002 |
| JP | 2002-264321 | 9/2002 |
| JP | 2002-275403 | 9/2002 |
| JP | 2003-170573 | 6/2003 |
| JP | 2004-050546 | 2/2004 |
| JP | 2004-107647 | 4/2004 |
| JP | 2005-181198 | 7/2005 |
| JP | 2005-254510 | 9/2005 |
| JP | 2006-062346 | 3/2006 |
| JP | 2006-199003 | 8/2006 |
| JP | 2007-152767 | 6/2007 |
| JP | 2007-276482 | 10/2007 |
| JP | 2007-313840 | 12/2007 |
| JP | 2008-062583 | 3/2008 |
| JP | 2009-160886 | 7/2009 |
| WO | 03/089247 | 10/2003 |

OTHER PUBLICATIONS

Australian Office Action conducted in Australian Appln. No. 2011350665 (Jul. 24, 2014).
International Search Report and Written Opinion in PCT/IB2011/056001, dated Feb. 29, 2012.
Japan Office Action conducted in Japan Appln. No. P2013-546815 (Aug. 4, 2015) (w/ English language translation).
Japan Office Action conducted in Japan Appln. No. P2013-546815 (Mar. 1, 2016) (w/ English language translation).
China Office Action conducted in China Appln. No. 201180067489.9 (Jul. 1, 2015) (w/ partial English translation).

* cited by examiner

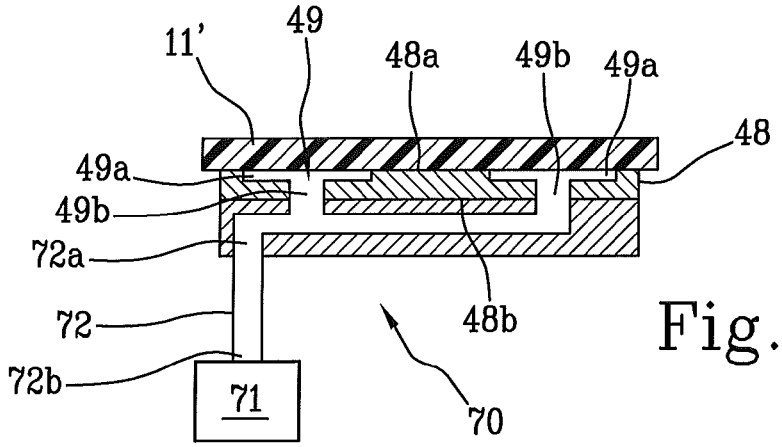
Fig.12
Fig.14
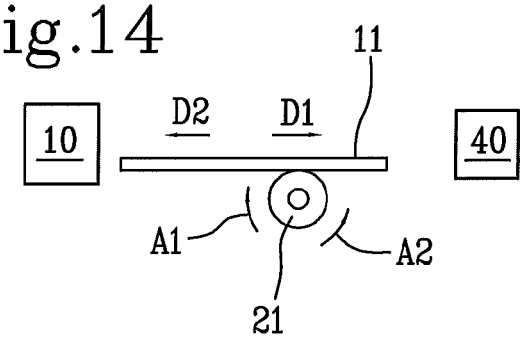
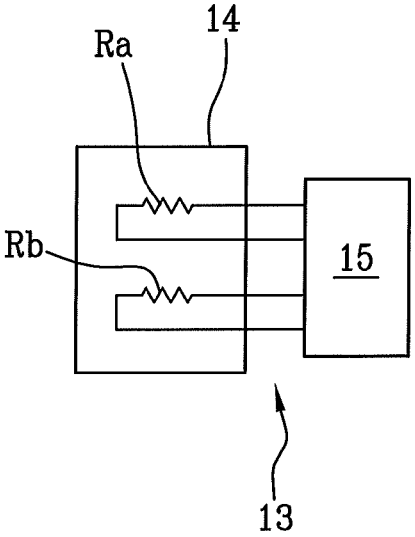
Fig.13
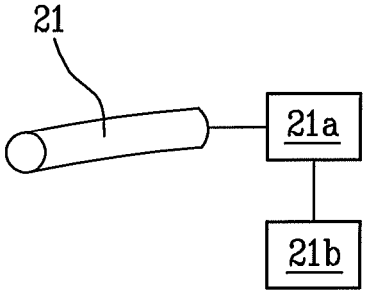
Fig.15

INK-JET PRINTER FOR PRINTING ON CARDS

CROSS-REFERENCE TO RELATED APPLICATIONS

This application is a U.S. National Stage Application of PCT/IB2011/056001, filed Dec. 29, 2011, claiming priority to Application No. MI2010A002478 filed Dec. 30, 2010.

BACKGROUND OF THE INVENTION

The present invention refers to an ink-jet printer for printing on cards.

In particular, the invention can be used for printing on cards made of plastic material such as, for example, credit cards, smart cards, magnetic cards, etc.

As known, these cards usually bear signs, images, trademarks, that help users to identify the purpose of the card and to distinguish each card from the others.

The state of the art provides for different techniques for printing on cards.

One solution consists of thermal printing, i.e. a printing activity wherein a thermal printer is used.

This solution is extremely complicated and expensive.

Other solutions envisage ink-jet printing, i.e. printing wherein ink-jet printers are used.

In a first ink-jet technique a film is deposited on the card before printing, and then the printing operation is carried out on such film; in other words, the ink ejected by the printer lands on the film previously deposited on the card's surface. The main drawback in this case is the low quality of the final result.

In a second ink-jet technique the printing operation on the card is performed with a temperature sensitive ink. When the printing operation is finished, the card undergoes a curing step, in which the ink is fixed to the card by the effect of heating obtained trough a UV lamp. A drawback of this solution is due to the time necessary for final curing step, which increases the overall time required for completing the printing process. Other drawbacks derive from the complexity and bulkiness of the apparatus for performing this kind of printing, since a UV lamp must be provided in addition to all the traditional components necessary for ink-jet printing.

SUMMARY OF THE INVENTION

An object of the present invention is to provide an ink-jet printer for printing on cards that is capable of printing on cards obtaining high quality results, i.e. cards on which the printed ink remains for a long time and is not easily removed by accidental hits or scrapes.

Another object of the present invention is to provide an ink-jet printer for printing on cards that can print quickly while obtaining a high quality result.

Another object of the present invention is to provide an ink-jet printer for printing on cards whose structure is simple and not expensive.

Another object of the present invention is to provide an ink-jet printer for printing on cards whose overall dimensions are limited.

These and other objects are achieved by an ink-jet printer for printing on cards according to the claims appended hereto.

Further features and advantages will be apparent from the description of a non-exclusive and preferred embodiment of the invention.

BRIEF DESCRIPTION OF THE DRAWINGS

The description is provided for herebelow with reference to the attached drawings, wherein:

FIG. 12 schematically shows the component of FIG. 11 associated with a suction system;

FIG. 13 is a block diagram of a pre-heating device used in the printer of FIGS. 1 and 2;

FIGS. 14 and 15 schematically show details of the printer of FIGS. 1 and 2:

DETAILED DESCRIPTION OF THE INVENTION

Figure 1:
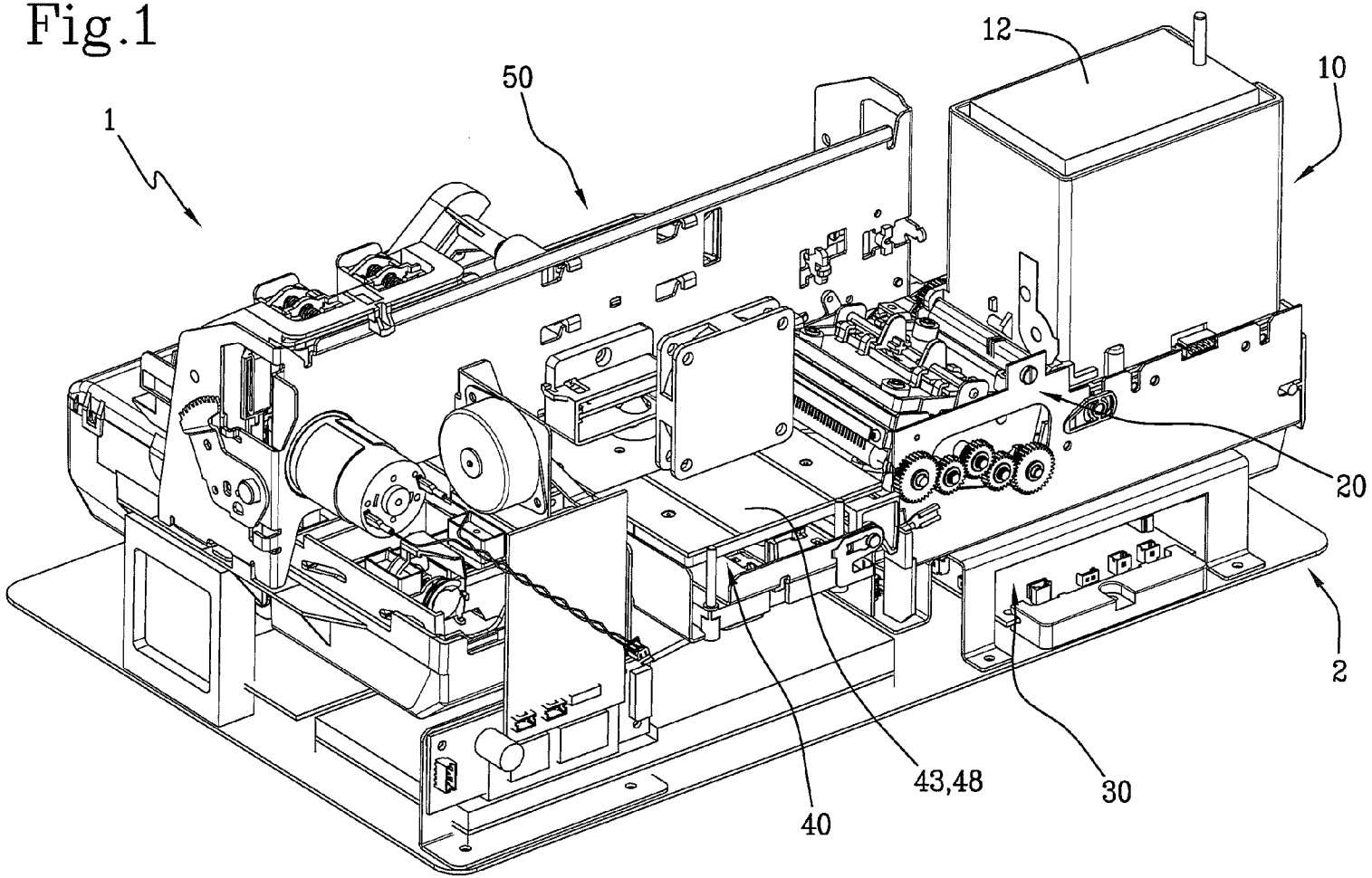
FIG. 1 is a schematic perspective view of the printer according to the present invention, wherein some parts have been eliminated in order to better see others.

In the attached drawings, reference numeral 1 indicates the ink-jet printer according to the present invention.

The printer 1 is suitable for ink-jet printing on cards like credit cards, smart cards, magnetic cards, etc.

The printer 1 (FIGS. 1, 2) comprises a storage zone 10

Preferably the cards 11 comprise a thermoplastic material.

In particular, the thermoplastic material can be selected in the group comprising: polyvinylchloride (PVC); polyvinylchloride (PVC) filled with mineral fillers; laminate polyvinylchloride (PVC); acrylonitrite-butadiene-styrene (ABS) terpolymers; polyethylenterephtalate (PET); glycol modified polyethylenterephtalate (PET-G); polylacticacid (PLA).

The laminate polyvinylchloride is formed by a central layer of polyvinylchloride filled with mineral fillers, and a couple of transparent polyvinylchloride films applied each on a respective surface of the central layer.

Preferably the cards 11 have a substantially plate-like shape, having a substantially rectangular shape in a plant view; the rectangular shape has a larger side and a smaller side.

Preferably the larger side has a length comprised between 80 mm and 90 mm, and in particular substantially equal to 85.7 mm Preferably the smaller side has a length comprised between 50 mm and 60 mm, and in particular substantially equal to 54 mm.

Preferably the plate-like shape has a thickness comprised between 0.4 mm and 0.8 mm, and in particular between 0.5 mm and 0.76 mm.

Preferably the dimensions of the card are in compliance with the ISO 7810 Standard and/or the CR80 Standard.

Preferably the cards 11 in the storage zone 10 are ordered from a first card 11*a* to a last card 11*b*.

Figure 4:
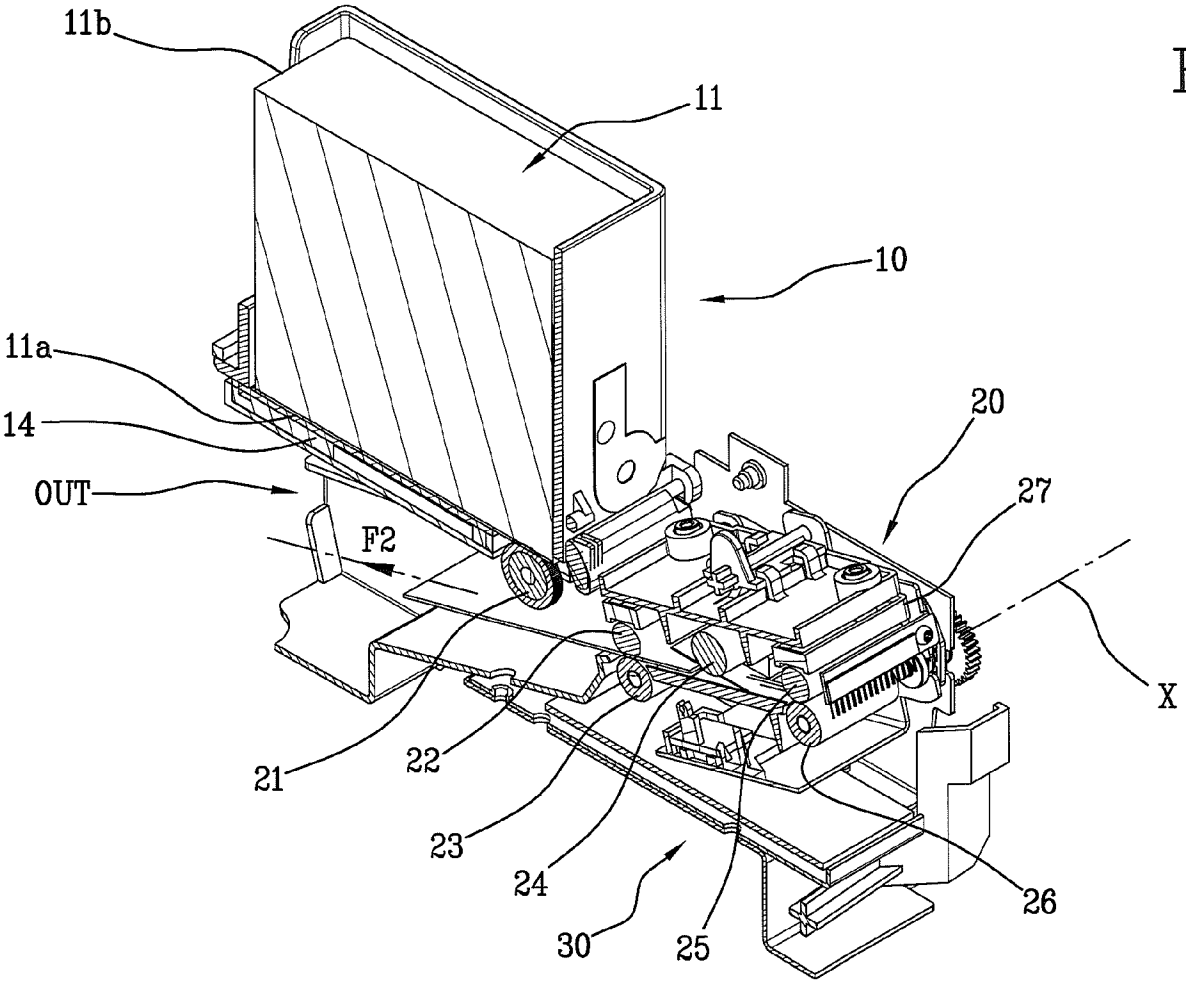
FIG. 4 is a cross-section of FIG. 3 according to plane IV-IV.

For example, as schematically shown in FIG. 4, the cards 11 can be piled up to form of column. In this case, the first card 11*a* is the one at the bottom of the column, and the last card 11*b* is the one at the top of the column.

As it will be clearer in the following, "first" and "last" are indicative of the order in which the cards 11 undergo the printing process.

The printer 1 comprises an extraction station 20 or picking station adapted to extract a card from the storage zone.

The extraction station 20 comprises at least one main roller 21 which can be put in contact with the first card 11*a* for extracting the same from the storage zone 10.

Preferably the main roller 21 is rotatably mounted on a frame 2 of the printer 1 below the storage zone 10, so that the weight of the pile of cards 11 helps to maintain the first card 11*a* in contact with the main roller 21.

In a preferred embodiment, an auxiliary weight 12 is placed on the top of the cards column, in order to provide an additional component to the force that pushes the first card 11*a* in contact with the main roller 21.

Preferably the extraction station 20 further comprises a plurality of auxiliary rollers 22-26 mounted downstream the main roller 21 so as to engage the card that advances due to the interaction with the main roller 21.

As schematically shown in FIG. 4, the plurality of auxiliary rollers may include a first couple of rollers 22, 23, an additional roller 24, and a second couple of rollers 25, 26.

Preferably, one or more of the auxiliary rollers 22-26 are rotatably mounted on a plate 27 hinged to the frame 2 of the printer 1.

Due to the oscillation around axis X, the plate 27 is movable between a first configuration and a second configuration.

In the first configuration the auxiliary rollers 22-26 mounted on the plate 27 are positioned so as to receive the card coming from the main roller 21 and bring the card forward for allowing it to be processed for printing. When the plate 27 is in the first configuration, the auxiliary rollers 22-26 are driven so as to move the card along the direction indicated by arrow F1 in FIG. 3, i.e. the card is moved away from the storage zone 10.

In the second configuration the auxiliary rollers 22-26 mounted on the plate 27 are positioned and driven so as to move the card towards an output OUT of the printer 1 located below the storage zone 10. When the plate 27 is in the second configuration, the auxiliary rollers 22-26 are driven in such a way that the card is moved along the direction indicated by arrow F2 in FIG. 4.

In other terms, the auxiliary rollers 22-26 mounted on the plate 27 define a reference plane that is the plane on which the card lies when it is engaged with such auxiliary rollers 22-26. In the first configuration, the reference plane is substantially aligned with the first card, whereas in the second configuration the reference plane is inclined towards the mentioned output OUT located below the storage zone 10.

Figure 3:
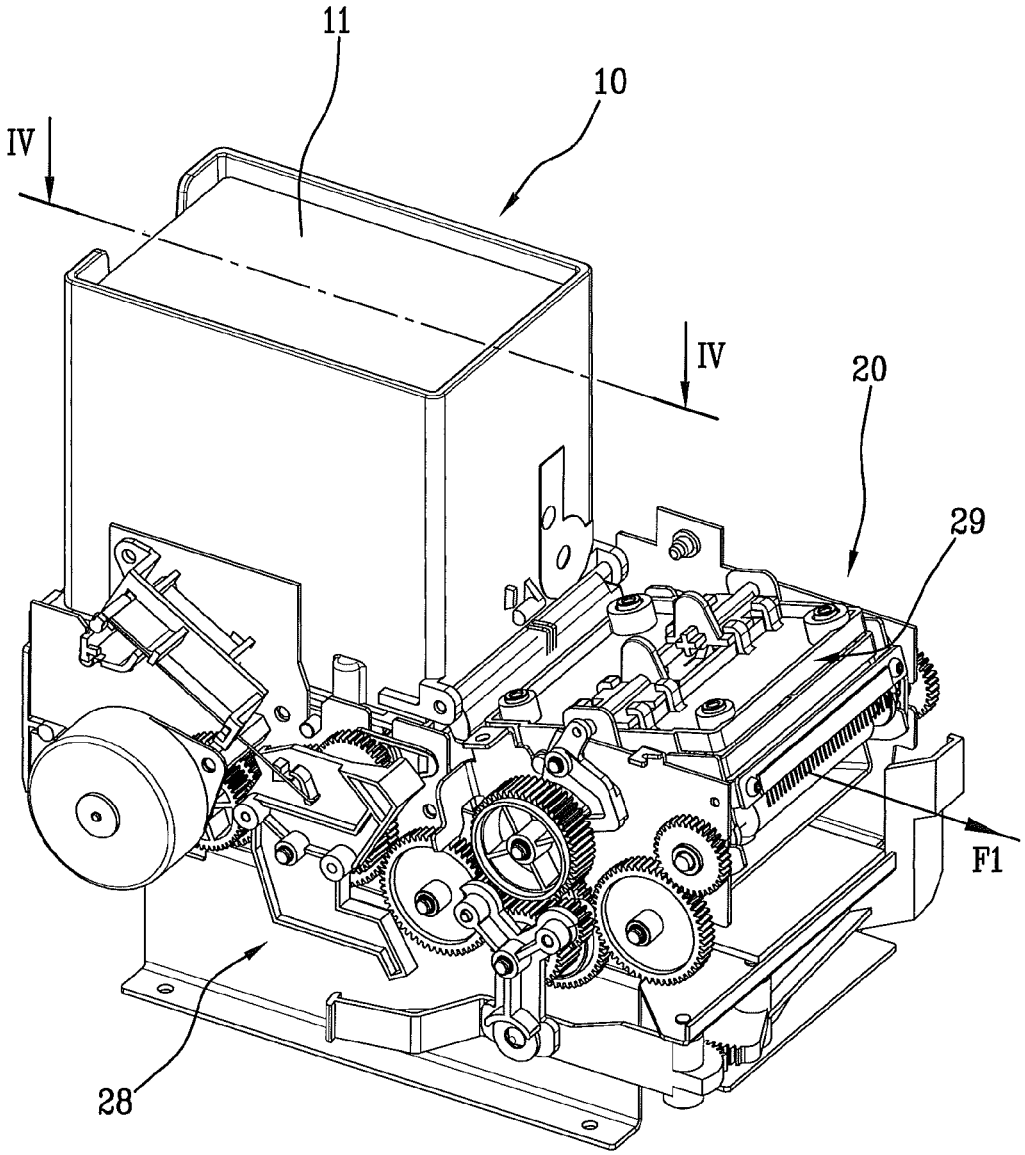
FIG. 3 is a schematic perspective view of a storage zone and an extraction station of the printer of FIGS. 1 and 2.

In FIG. 3, reference numeral 28 denotes the mechanism that drives the plate 27 between the first and the second configurations.

Preferably, the printer 1 further comprises a magnetic processing station 30 adapted to read/write data from/on a magnetic portion of the cards.

The magnetic processing station 30 is per se known; thus it will not be disclosed in the present specification.

In a preferred embodiment the magnetic processing station 30 is associated with the extraction station 20, so as to be interposed between the storage zone 10 and a support carriage 40 that will be disclosed in detail in the following.

In particular, the magnetic processing station 30 can be arranged under a part of the extraction station 20, as schematically shown in FIGS. 1 and 4.

Preferably the portion of extraction station 20 located over the magnetic processing station 30 is removably mounted to the frame 2 of the printer 1. In this way an advantage is obtained in that the magnetic processing station 30 is easily accessible for cleaning and/or maintenance operations.

In FIG. 3 the removable structure is denoted at 29.

In view of the above, the aforementioned second configuration of the plate 27 and the output located below the storage zone can be used, for example:

- when a card needs only a magnetic processing, and it must not be printed;
- when, following the read/write operation, the card is determined to be unsuitable for further processing, so that it has to be eliminated as soon as possible.

The printer 1 further comprises a support carriage 40 on which the card extracted by the extraction station 20 is placed.

In particular, the card 11' reaches the support carriage 40 thanks to the activity of the cited auxiliary rollers 22-26.

Figure 5:
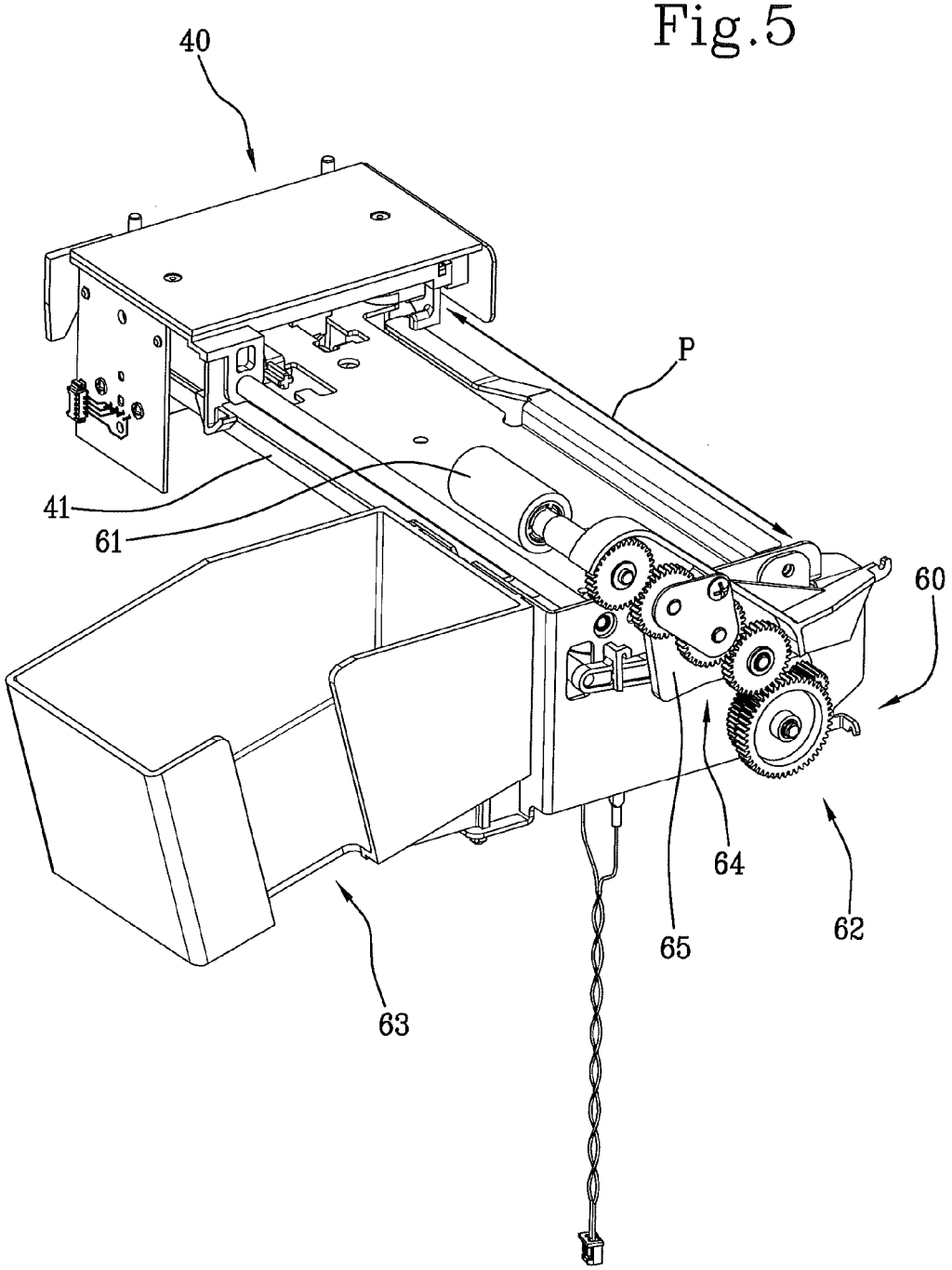
FIG. 5 is a schematic perspective view of a carriage and an ejection station of the printer of FIGS. 1 and 2.

The carriage 40 moves along a path P, as schematically shown in FIG. 5.

Preferably, the path P is substantially rectilinear.

Preferably, the carriage 40 moves along a guide plate 41, driven by a respective electric motor.

The carriage 40 receives the card 11' from the extraction station 20 and brings it to a printing station, that will be disclosed in more detail in the following.

In a preferred embodiment, the carriage 40 is movable in a first position P1, in a second position P2 and in a third position P3.

In the first position P1 (FIGS. 1, 9), the carriage 40 is positioned immediately downstream with respect to said extraction station 20, so that the auxiliary rollers 22-26 included in the extraction station 20 guide the card 11' from the storage zone 10 to the carriage 40.

In the second position P2 (FIG. 6, 9), the carriage 40 is at the printing station 50, where the carriage 40 remains as long as the printing on the card 11' is performed.

In the third position P3, (FIG. 9) the carriage 40 is positioned immediately upstream with respect to an ejection station, so that the card that has been printed can be sent out of the printer 1.

Figure 9:
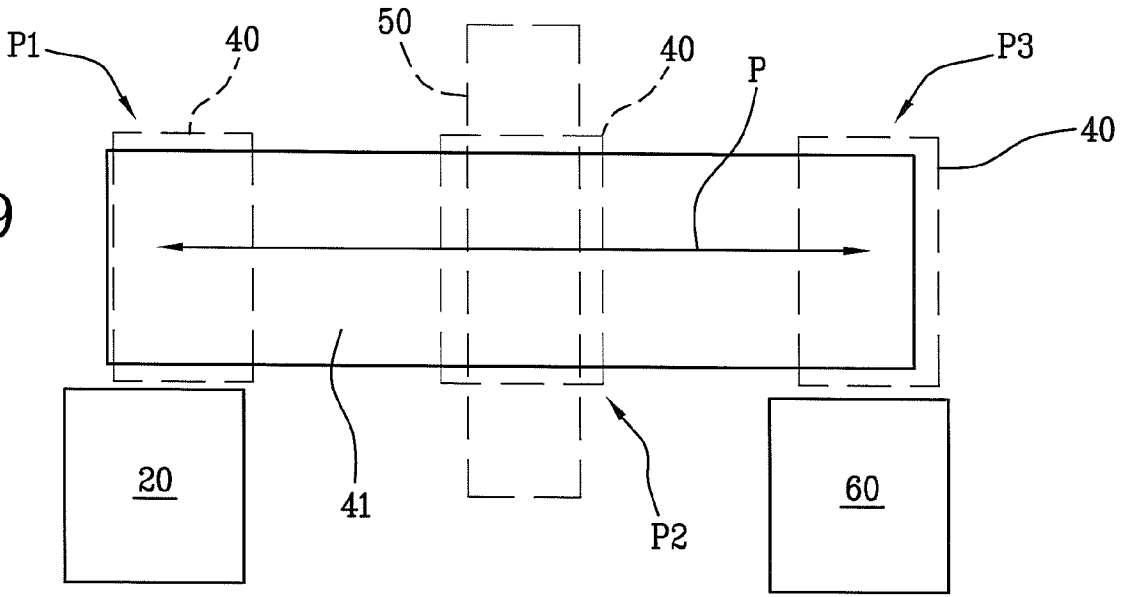
FIG. 9 schematically indicates three possible positions of the carriage of the printer of FIGS. 1 and 2.

Preferably, the first, second and third positions P1, P2, P3 are defined along said guide plate 41, as schematically shown in FIG. 9.

Preferably, the second position P2 is interposed between the first position P1 and the third position P3.

Preferably the aforementioned electric motor, that drives the carriage along its path P, is controlled by an electronic unit, that is synchronized with the remaining devices of the printer 1. In this way, the electronic unit is informed, for example, about the activity of the extraction station 20 and of the printing station 50. As a consequence:

when a card is to be extracted, the carriage 40 is positioned at the first position P1, so that the extracted card can be properly received by the carriage 40;

when the printing station 50 is about to start the printing step, the carriage 40 is moved to the second position P2, and remains there until the end of the printing step, so that the ink ejected by the printhead correctly lands onto the card's surface;

when the printing operation is finished, the carriage 40 can be moved to the third position P3 for ejection of the card.

Advantageously, the carriage 40 is provided with a heating system 42 (FIG. 10) for heating the card 11' during operation of the printing station 50.

Preferably the heating system 42 comprise a heating element 43 that is kept in contact with the card 11' during the printing operation.

Preferably, the heating element 43 is a plate-like element 48.

Preferably the heating element 43 has a shape, in a plant view, similar to that of the card 11'.

For example, the heating element 43 can have a substantially rectangular shape, having a larger side comprised between 75 mm and 85 mm, and in particular substantially equal to 81.7 mm and a smaller side comprised between 45 mm and 55 mm, and in particular substantially equal to 51 mm.

It is to be noted that the card 11' is preferably larger than the plate-like element 48. For example the card can be 4 mm larger than the plate-like element 48. Accordingly, the ink ejected by the printing station does not reach the plate-like element 48, since the latter is shielded by the card 11'. This feature achieves an advantage in that the plate-like element 48 is, in practice, a printed circuit board (PCB), that would be damaged by an interaction with the ink ejected by the printing station 50.

Preferably the heating system 42 further comprise a control circuit 44 operatively associated with the heating element 43 for controlling the temperature of the same heating element 43.

Preferably the heating element 43 comprises one or more resistors R1, R2; the control circuit 44 is connected to said one or more resistors R1, R2 for making an electrical current flow through the same and heat said card 11'.

In particular R1 is a Warm-up Resistance and R2 is a maintenance Resistance; during heating from the ambient temperature Tambient to Set temperature Tset is used R1, and R2 is used for maintaining Tset during the printing; in order to reach Tset in a shorter time and to have a little power consumption during the printing R1 power is greater than R2 power. In practice, the control circuit 44 provides for a controlled voltage across the one or more resistors R1, R2, so that heat is obtained by Joule effect. The plate-like element 48 helps to spread such heat so that the whole card 11' is brought and maintained at a preset temperature.

For example, the temperature of the card during the printing operation is comprised between 45° C. and 85° C.

Advantageously the temperature is chosen depending on the specific material of which the card is made.

For example, in case the cards are made of PVC, the temperature can be 60° C. or less; if the cards are made of other materials, the temperature can be up to 80° C.

Preferably the control circuit 44 comprises a main sensor 45 adapted to detect a parameter representative of a temperature of the heating element 43; in a preferred embodiment the main sensor 45 is mounted on the heating element 43.

In practice, the main sensor 45 can be a temperature sensor.

The control circuit 44 further comprises a control unit 46 connected to the main sensor 45 and to the heating element 43 for regulating the temperature of the heating element 43 depending on the parameter detected by the main sensor 45.

In more detail, the control unit 46 receives the parameter detected by the main sensor 45 and compares such parameter with a preset reference value, that is representative of the temperature at which the heating element 43 must be brought and/or maintained. If the detected value and the reference value are different from each other, the control unit 46 regulates the current through the cited resistor(s) R1, R2 accordingly.

In the most frequent situation the detected temperature is lower than the desired one; in this case, the control unit 46 provides for a suitable voltage across the heating resistor(s) R1, R2 so that the temperature of the heating element 43 is increased.

When the reference temperature is reached, the power supplying to the resistor(s) R1, R2 is interrupted.

The control circuit 44 as disclosed hereabove is configured for controlling the temperature of the heating element 43.

However it is to be noted that the parameter that actually should be monitored as precisely as possible is the temperature of the card 11', which may be slightly different from the temperature of the heating element 43. This difference may cause significant effects regarding the quality of printing and reliability of the bond between the card and the colour that is printed on the same card. If the material of which the card 11' is made is a priori known, the temperature difference between the card 11' and the heating element 43 can be determined quite easily in advance (it may be equal, for example, to approximately 1° C.). In this case, the control circuit 44 as disclosed above can obtain satisfactory results and the printing process can be successfully carried out.

By contrast, in case the material of which the card is made in not a priori known, problems may arise since the temperature of the card is actually never available, so that it may be difficult to bring and maintain the card at an optimal temperature during the printing process. Likewise, the result will necessarily be characterized by a low quality.

In order to prevent this problem the printer 1 can be provided with an auxiliary sensor 47, operatively associated with the card 11' for detecting a parameter representative of a temperature of the same card 11' during the printing operation; the auxiliary sensor 47 then sends the detected parameter to the control unit 46.

The control circuit 44 is configured for regulating the temperature of the heating element 43 depending on the parameter detected by the auxiliary sensor 47.

In this way, the temperature of the card 11' is directly controlled during the printing operation and the likelihood of an optimal result is significantly increased.

Preferably the auxiliary sensor 47 is an infra-red sensor.

Preferably, the auxiliary sensor 47 is mounted on said printing station 50. A preferred position of the auxiliary sensor 47 will be better disclosed when the printing station 50 is taken into consideration.

Preferably the printer 1 further comprises a suction system 70 (FIG. 12) engaged with the carriage 40 and operatively active on the card 11' for keeping the same card in contact with the plate-like element 48, i.e. with the heating element 43.

Figure 11:
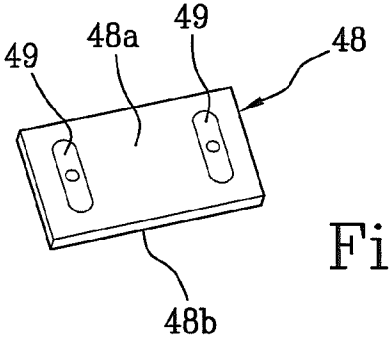
FIG. 11 is a schematic perspective view of a component of the heating system of FIG. 10.

In particular, the plate-like element 48 has a first and a second surface 48*a*, 48*b* (FIGS. 11, 12) opposite to each other. The first surface 48*a* is in contact with the card 11' and, in use, is the upper surface of the plate-like element 48. The second surface 48*b* is engaged with the suction system 70.

The suction system 70 preferably comprises a pump 71 and at least one conduit 72; the conduit 72 has a first end 72*b* connected to the pump 71, and a second end 72*a* connected to the second surface 48*b* of the plate-like element 48.

Preferably the plate-like element 48 has one or more through holes 49 for allowing said suction 70 system to act on said card 11'.

In practice, the suction action generated by the pump 71 is transmitted to the card 11' through the conduit 72 and the one or more through holes 49 of the plate-like element 48.

Preferably one or more of the one or more through holes 49 have a first portion 49*a* and a second portion 49*b*.

The first portion 49*a* ends on the first surface 48*a* of the plate-like element 48. The first portion 49*a* has a cross-section, on a first plane substantially parallel to the planar extension of the plate-like element 48. Such cross-section is referred to as "first cross-section".

The second portion 49*b* ends on the second surface 48*b* of the plate-like element 48. The second portion 49*b* has a cross-section, on a second plane having the same position as (i.e. being distinct from and parallel to) said first plane. Such cross-section is referred to as "second cross-section".

Preferably, the first cross-section is larger than the second cross-section. Advantageously, this improves the suction engagement between the card 11' and the plate-like element 48.

The suction system 70 is particularly advantageous in order to obtain the so-called "borderless printing", i.e. a printing wherein 100% of the card's surface can be actually used.

In fact, by employing the above cited suction system 70, no further grabbing/picking/handling members are necessary, that would be at least partly interposed between the printhead and the card's surface during the printing operation, thereby preventing the ink to reach the whole surface of the card.

In order to optimize the interaction between the suction system 70 and the card 11', the printer 1 can be provided with a pressing device 80, adapted to press the card 11' onto the plate-like element 48 when the suction system 70 is activated.

In practice, the pressing device 80 acts on the card 11' so that the latter optimally adheres to the plate-like element 48; likewise, depression can be generated through the through hole(s) 49, thereby reliably engaging the card 11' to the carriage 40.

Figure 17:
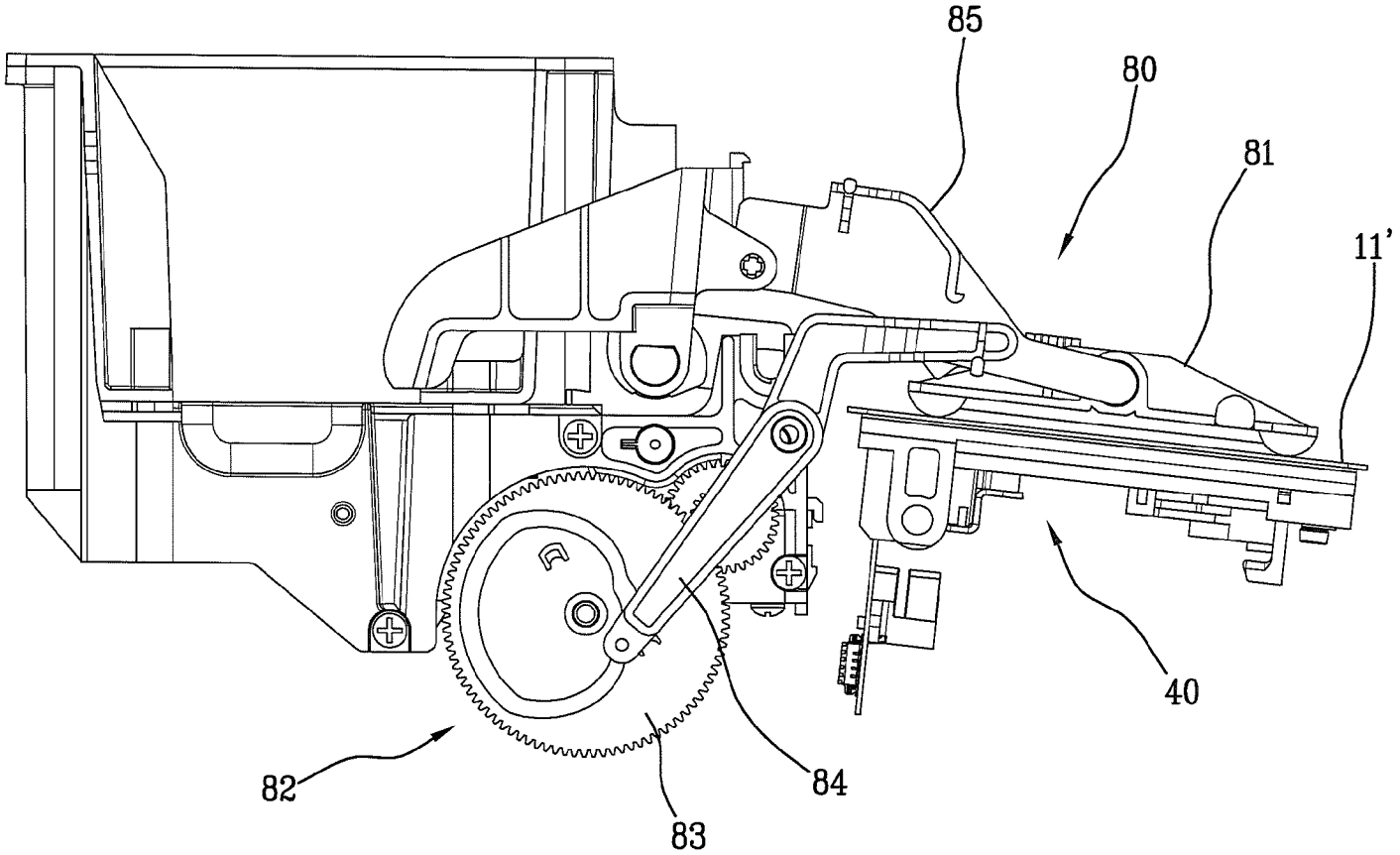
Figure 18:
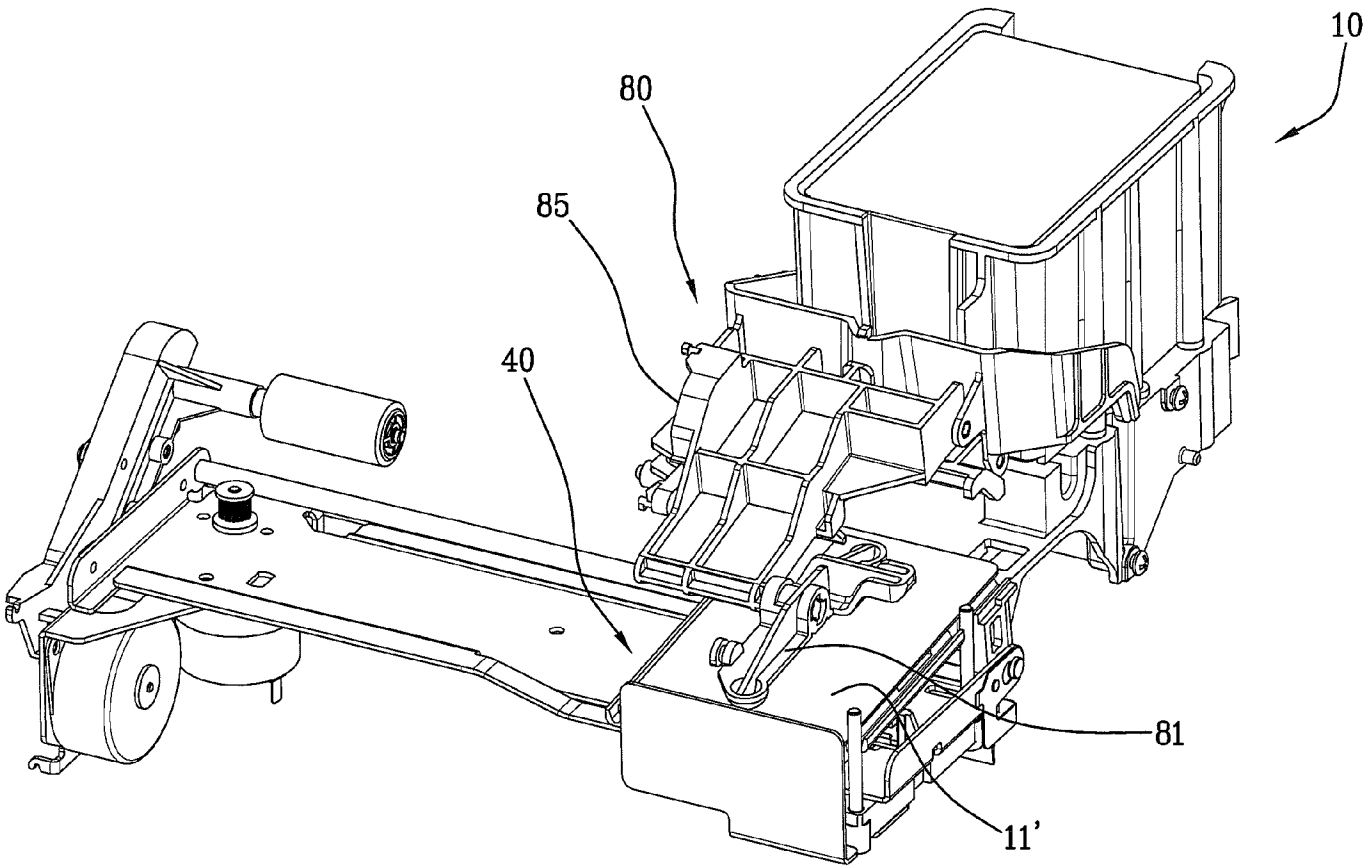

FIG. 18 shows a schematic perspective view of the pressing device 80. Such device is disclosed in more detail herebelow with reference to FIGS. 16 and 17.

Figure 16:
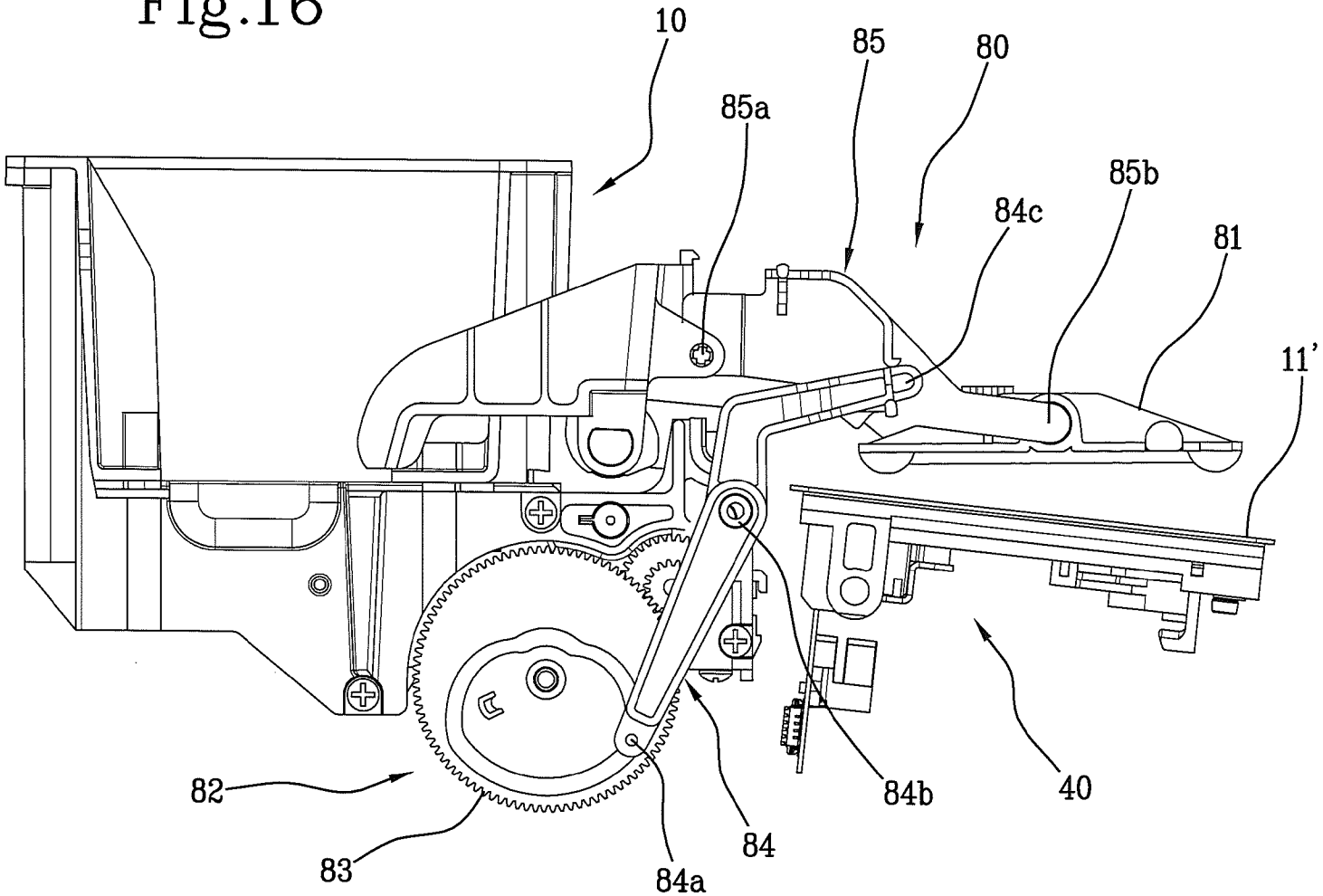
FIGS. 16-18 show schematically a pressing device included in the printer of FIGS. 1 and 2.

It is to be noted that FIGS. 16-18 show a schematic representation of a preferred embodiment of printer 1, wherein the magnetic processing station 30 is not provided for and the extraction station 20 is embedded in the lower portion of the storage zone 10.

Figure 2:
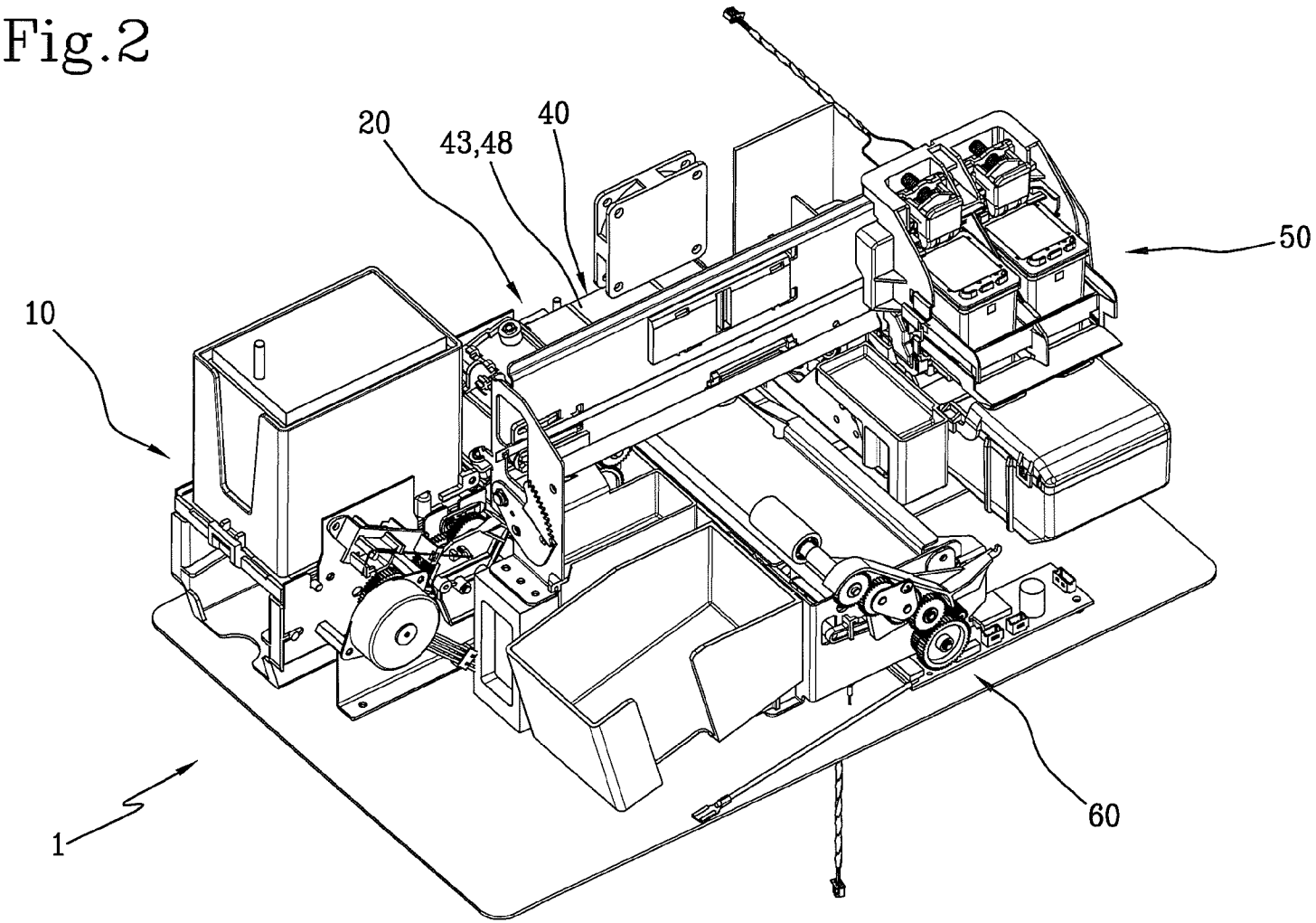
FIG. 2 is a different schematic perspective view of the printer of FIG. 1.

The pressing device 80 can be anyway applied to other embodiments, such as that shown in FIGS. 1-2, provided that the size of the elements included in the pressing device 80 (e.g. the main lever 84) is properly dimensioned.

Preferably, the pressing device 80 comprises a pressing member 81, configured to act on the card 11'.

Preferably, the pressing member 81 is an elongated element, that is arranged so that its larger dimension is substantially parallel to the larger side of the card 11'.

Preferably the pressing member 81 act on a substantially central portion of the card 11'.

The pressing member 81 is drivable between a first position, wherein it is not in contact with the card 11' (FIG. 16), and a second position, wherein it is in contact with the upper surface of the card 11' and pushes the card 11' against the plate-like element 48 (FIG. 17).

In order to drive the pressing member between its first and second positions, the pressing device 80 comprises a drive mechanism 82, that is operated by a motor (not shown).

Preferably, the drive mechanism 82 comprises a wheel 83, on which a main lever 84 is eccentrically pivoted at a first end 84*a*. The wheel 83 is moved by the above mentioned motor.

A central portion 84*b* of the main lever 84 is pivoted to the frame 2 of the printer 1. A second end 84*c* of the first lever 84 drives, preferably by means of a connection member 85, the pressing member 81.

Preferably, the second end 84*c* of the main lever 84 is hinged to a central portion of the connection member 85.

Preferably, the connection member 85 has a first end 85*a* pivoted to the frame 2 of the printer 1, and a second end 85*b* pivoted to a central portion of the pressing member 81.

When the wheel 83 is driven so that the distance between the first end 84*a* of the main lever 84 and the rotation center of the wheel 83 is large, the pressing member 81 is in its first position (FIG. 16).

When the wheel 83 is driven so that the distance between the first end 84*a* of the main lever 84 and the rotation center of the wheel 83 is small, the pressing member 81 is in its second position (FIG. 17).

With reference to the overall working of the printer 1, the pressing member 81 is preferably always kept in its first position, apart from the circumstance in which the card 11' has just been positioned on the carriage 40, i.e. when the card 11' has just been released by the extraction station 20. In this situation, the suction system 70 is activated, and the pressing member 81 is driven in its second position. Once the card 11' is secured to the carriage 40, the pressing member 81 is brought back in its first position.

As mentioned above, the carriage 40 brings the card 11' to the printing station 50, wherein marks, images, and any kind of signs can be printed on the card 11'.

The printing station 50 (FIGS. 6 and 7) comprises at least one ink-jet printhead 51 for ink-jet printing on said card 11'.

The printhead 51 is provided with or coupled to at least a reservoir 52 containing ink. Said ink comprises:

- a medium, or vehicle, consisting of a low-boiling organic solvent;
- an auxiliary solvent consisting of a high-boiling organic solvent;
- a colouring component soluble in said medium.

Preferably the vehicle has a boiling temperature lower than 120° C. and in particular lower than 80° C.

Preferably the vehicle is selected in the group of alcohols.

For example, the vehicle can be ethanol, n-propanol, n-butanol.

The vehicle has the tasks of dissolving the various components of the ink and sustaining the formation of the ink bubbles.

Preferably the auxiliary solvent has a boiling temperature higher than 120° C. and in particular higher than 150° C.

Preferably the auxiliary solvent is able to dissolve or to swell the plastic materials, and in particular the thermoplastic material of the cards.

Preferably the auxiliary solvent is soluble in the vehicle.

For example, the auxiliary solvent can be selected in the group comprising: N-methyl-2-pyrrolidone, N-ethyl-2-pyrrolidone, 1,3-dimethyl-imidazolidinone, ϵ-caprolactone, γ_butyrolactone; glycol ethers like: ethylene glycol monomethyl ether, diethylene glycol monobutyl ether, triethylene glycol monomethyl ether, esters like: ethyl lactate, ethyl acetate; or mixtures thereof.

Preferably the colouring component is soluble in the vehicle.

In this context and in the following claims, the term "soluble" indicates solubility in the vehicle of at least 10% w/w.

Preferably, the colouring components belongs to the so called Solvent family according to the Colour Index terminology.

Preferably the colouring component is a substance that is capable of dissolving in the plastic material of which the cards are made, so as to become integral with the cards and to obtain an optimal printing.

For example, the colouring component can be selected in the group comprising: solvent black 29, solvent black 27; solvent blue 67, solvent blue 44, solvent blue 70; solvent yellow 82, solvent yellow 88; solvent red 125, solvent red 122.

Preferably, the ink also comprises one or more additives such as, for example, levelling agents, in order to improve the uniformity of the distribution of the ink on the cards.

For example, such additives can include silicon derivatives.

In view of the above, it is clear that an optimal printing quality and durability of the printed cards are achieved.

In fact, in the process of printing on non-porous surfaces, as those of the cards, the phenomenon that causes fixing of the colour on the surface is not penetration (as, for example, in printing on paper), but the chemical attack by the high-boiling organic solvent towards the plastic material of the card. This solvent softens the surface of the plastic card, so that the diffusion of the colouring component in the polymeric structure of the surface is promoted.

Therefore, by employing the above indicated substances, and by heating the card during the printing operation, it is possible to ink-jet print on plastic cards obtaining high quality and durable results.

Figure 6:
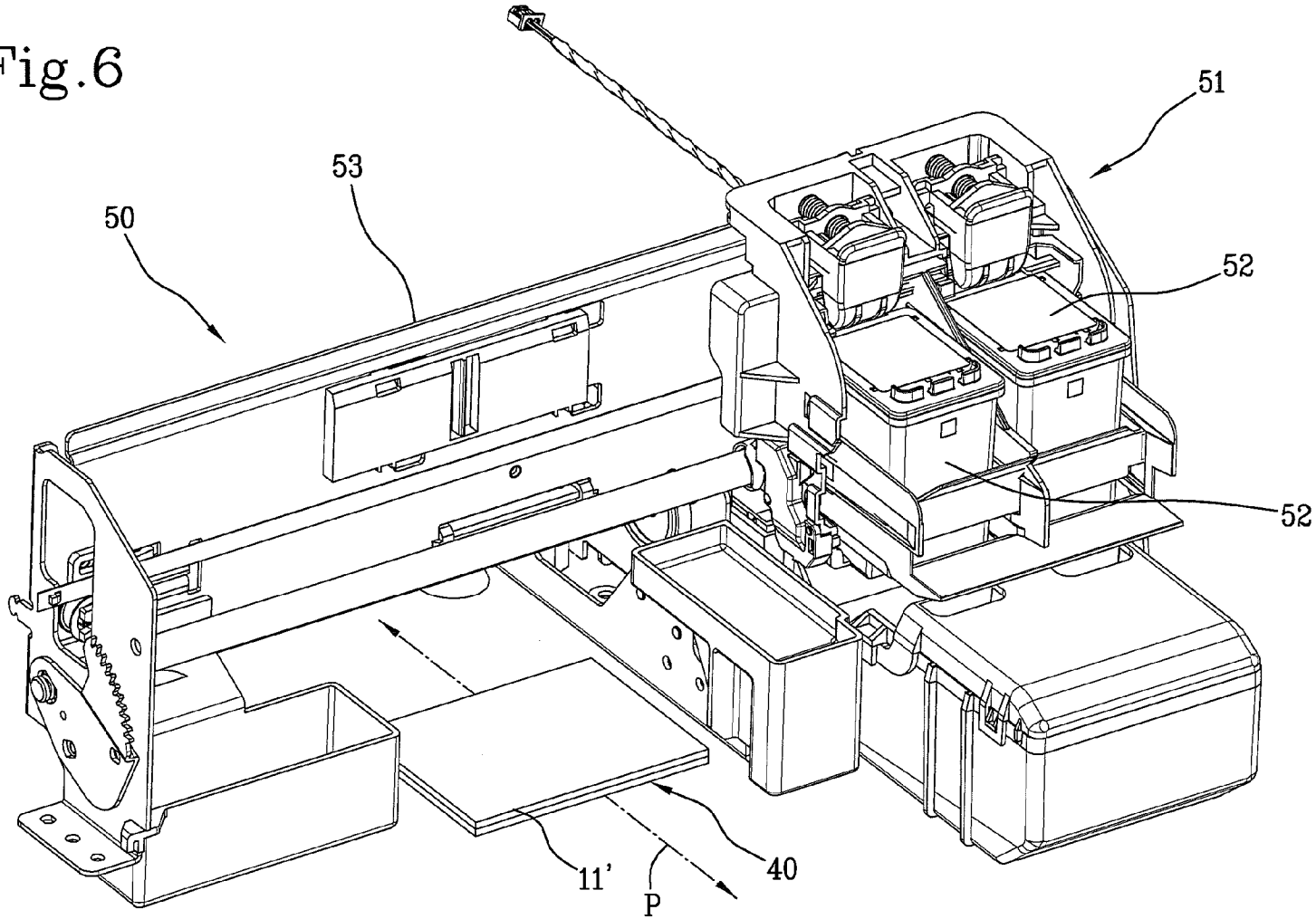
FIG. 6 is a schematic perspective view of a printing station of the printer of FIGS. 1 and 2.
Figure 7:
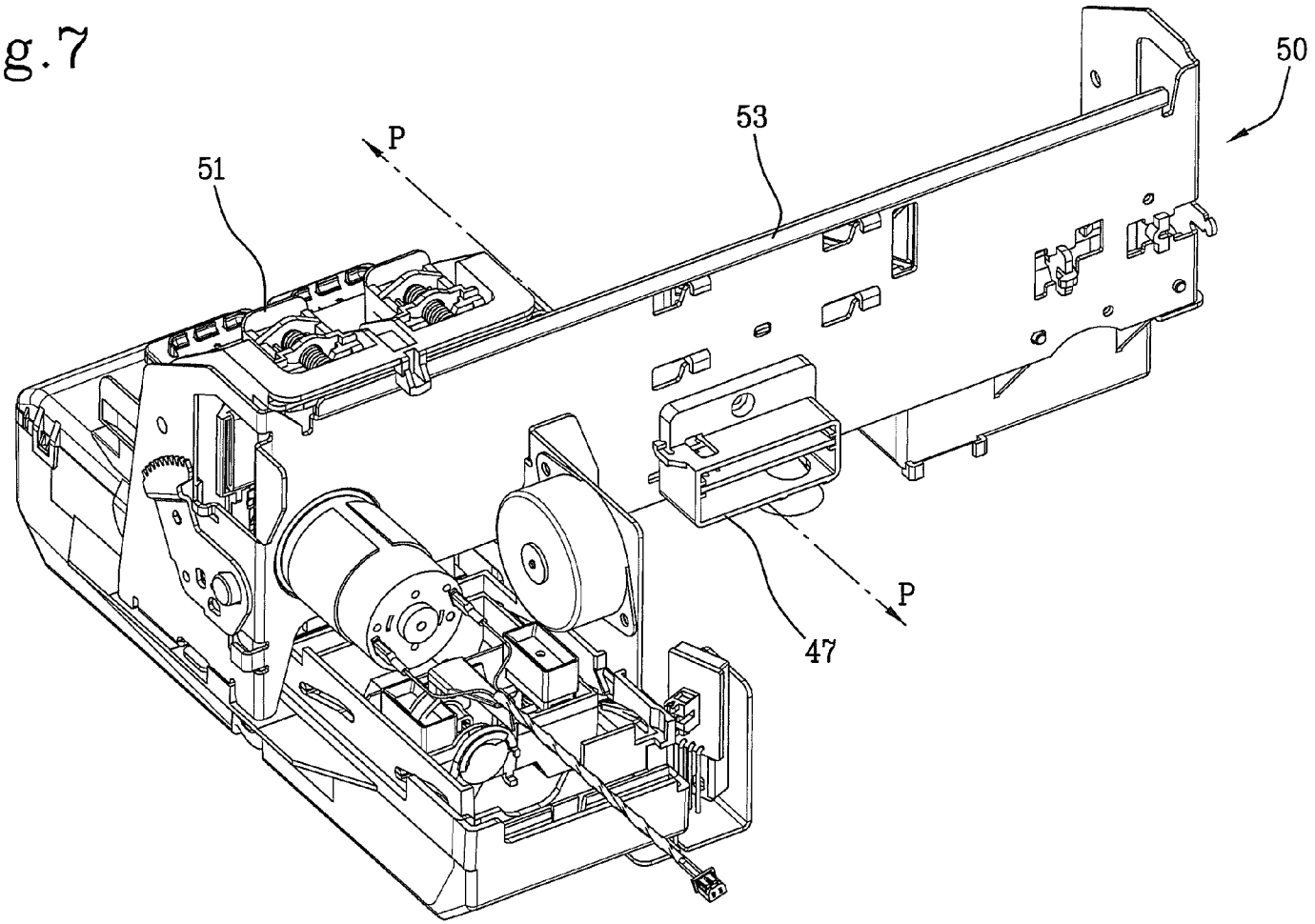
FIG. 7 is a different perspective view of the printing station of FIG. 6.
Figure 8:
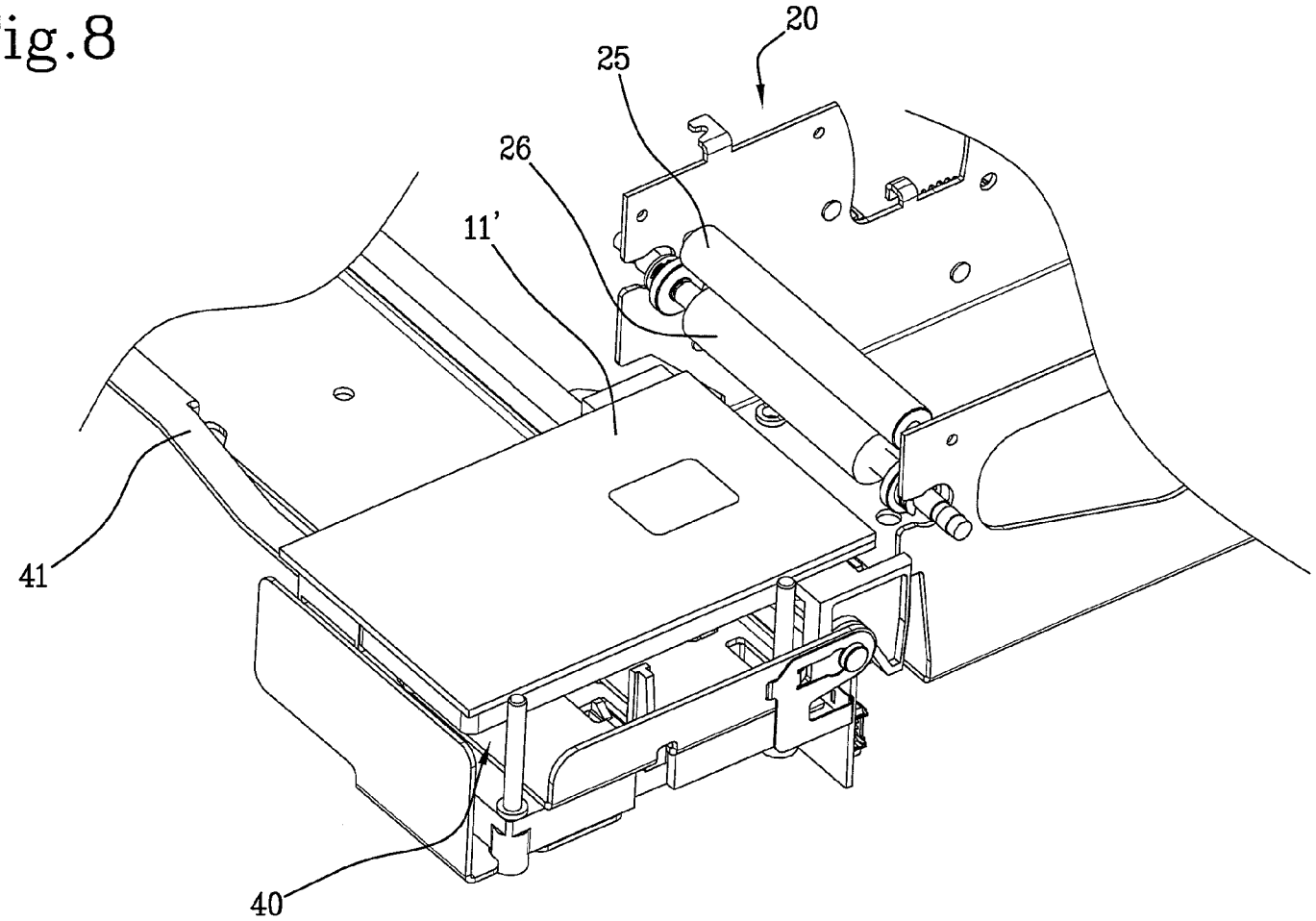
FIG. 8 is a schematic perspective view of the carriage of the printer of FIGS. 1 and 2 wherein a card is positioned on said carriage.

It is to be noted that increasing the card temperature during the printing process has two aims:

increasing the evaporation velocity of the vehicle;

increasing the velocity of interaction between auxiliary solvent and the plastic material of the card As schematically shown in FIGS. 6, 7, the printing station 50 comprises a support plate 53 for the printhead 51. The support plate 53 is oriented according to a direction transverse to the path P of the carriage 40. In practice, the carriage 40 moves along the direction indicated by arrow P; the support plate 53 is transverse, and preferably perpendicular, to such direction.

As already discussed, during the printing operation the carriage 40 is in the second position P2, and does not move until the printing operation is finished.

During the printing operation, the printhead 51 is moved back and forth along the support plate 53, while ejecting ink onto the card 11'.

The support plate 53 is mounted to and integral with the frame 2 of the printer 1.

Preferably, the aforementioned auxiliary sensor 47 is mounted on the support plate 53 (FIG. 7). In particular, it is mounted on the support plate at a position of minimum distance from the path P of the carriage 40.

In practice, the auxiliary sensor 47 can be mounted at the intersection of the carriage path P with the support plate 53.

Accordingly, the distance between the auxiliary sensor 47 and the card 11' during the printing operation is minimized and the detection of the card temperature is reliable and precise.

As disclosed above, the heating of the card is important for the quality and durability of the result of the printing process.

In order to further improve both the quality and the speed of the printing process, the storage zone 10 is provided with a pre-heating device 13 (FIGS. 4, 13) for heating at least the first card 11*a*.

Preferably the pre-heating device 13 comprises: a plate-like pre-heating element 14 in contact with the first card 11*a* in the storage zone 10; a control module 15 for regulating the heating of said pre-heating element 14.

The pre-heating element 14 is positioned right below the pile of cards 11 in the storage zone 10. In practice, the first card 11*a* lies on the pre-heating element 14.

Likewise, the first card 11*a* is maintained at a temperature, referred to as "intermediate temperature", that is comprised between the room temperature and the temperature at which the card is brought for printing, so as to reduce the time needed for bringing the card at the desired printing temperature.

For example, the intermediate temperature can be about 45° C.

Advantageously, the pre-heating element 14 is associated with at least one resistor Ra, Rb, through which a suitable current flows in order to achieve the desired temperature.

In a preferred embodiment, the control module 15 is configured for driving said pre-heating element 14 between at least two operating conditions, in which said pre-heating element 14 is maintained at respective different temperatures.

The provision of two different pre-heating temperatures can be useful, for example, if the printer is adapted to work in two different conditions:

"single printing", wherein a certain amount of time lapses between printing of a card and printing of the subsequent card; in this case, the lower pre-heating temperature is used;

"continuous printing", wherein the cards are printed in succession, one after the other, with no substantial pause for the carriage; in this case, the higher pre-heating temperature will be used.

Figure 10:
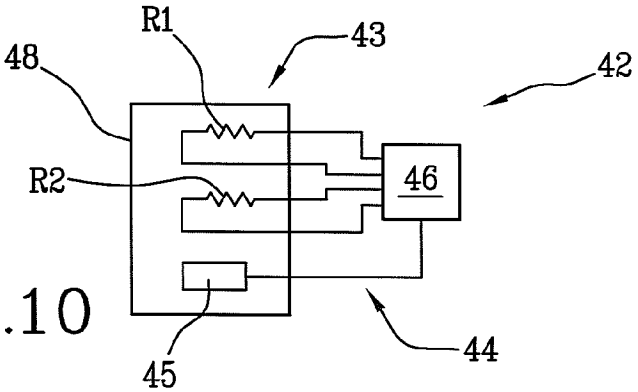
FIG. 10 is a block diagram of a heating system used in the printer of FIGS. 1 and 2.

In order to obtain the two different pre-heating temperatures, the pre-heating element 14 can be associated with at least one or two resistors Ra, Rb, having different resistances, controlled by a sensor similar to the sensor 45 of the heating element 43 of FIG. 10.

As mentioned above, the extraction station 20 is provided with a main roller 21 that causes the first card 11*a* to proceed towards the carriage 40 (if the latter is in its first position P1, or is about to be positioned in its first position P1).

Preferably the extraction station 20 further comprises a recovering system 29 for recovering a possible further card extracted together with the first card 11*a* and place again the further card on the pre-heating plate-like element 14.

In other words, it may happen that not only the first card 11*a* is moved forward by the main roller 21, but also a further card, for example due to the friction engagement between the first card and such further card. Typically the further card is the card immediately over the first card, that may be considered the "second card" according to the order in which the cards 11 are arranged in the storage zone 10.

The recovering system 29 operate so as to pull back the further card and place it back at its initial position, i.e. on the pre-heating element 14.

This feature is advantageous because it guarantees that the card at the bottom of the pile of cards is properly positioned on the pre-heating element 14, so that the pre-heating operation is carried out properly and the quality and quickness of the printing process is maximized.

Preferably the aforementioned main roller 21 is drivable in a first direction of rotation A1 for moving the first card towards said carriage 40 (FIG. 14, arrow D1), and in a second direction of rotation A2 opposite to the first direction of rotation A1.

When the main roller 21 is driven to rotate in the second direction of rotation A2, it defines the recovering system 29.

In more detail, after the first card 11*a* is moved forward by the main roller 21, such card is engaged by a couple of rollers 22, 23 for prosecution of the movement towards the carriage 40. When the first card 11*a* is no more engaged with the first roller 21, the latter can be driven in the second direction of rotation A2. In this way, if a further card has partially followed the movement of the first card 11*a*, such further card is engaged by the main rolled 21 rotating in the second direction of rotation A2 and is placed back at the bottom of the pile of cards.

Arrow D2 in FIG. 14 schematically identifies the movement direction of a card 11 when the main roller 21 rotates in the second direction A2.

Preferably, the extraction station 20 comprises an electro-mechanical actuator 21*a* (FIG. 15) operatively active on the main roller 21 for activating the main roller 21 in the first or in the second direction A1, A2 of rotation.

For example, the electro-mechanical actuator 21*a* can be an electric motor, whose output shaft is connected with the main rolled 21 by means of a suitable mechanism.

Preferably the extraction station comprises a processing unit 21*b* configured for commanding the electro-mechanical actuator 21*a* so as to drive the main roller 21 in the first or second direction of rotation A1, A2.

Advantageously, the processing unit 21*b* can be connected with a sensor, associated with the main roller 21 and/or with the auxiliary rollers 22-26, that generates a signal representative of the engagement/disengagement of the extracted card with the main roller/auxiliary rollers 21, 22-26. In this way, the processing unit 21*b* is informed about the position of the extracted card, and can determine the direction of rotation of the main roller 21 accordingly. In particular:

- when the first card 11*a* is still engaged with the main roller 21, the latter is driven in the first direction of rotation A1;
- when the first card 11*a* is no more engaged with the main roller 21, the latter is driven in the second direction of rotation A2.

Advantageously, the printer 1 further comprises an ejection station 60 where the card 11' is brought by the carriage 40 after printing. The ejection station 60 is adapted to eject the card after is has been printed.

As mentioned above, the ejection station 60 is preferably positioned close to the end of the support carriage's stroke or path P, i.e. at the third position P3 of the carriage 40.

As schematically shown in FIG. 5, the ejection station 60 comprises an ejection roller 61 activated by an activation mechanism 62.

In use, the ejection roller 61 is in contact with the upper surface of the card 11' and, rotating, acts on the card in order to eject the same.

After being ejected, the card 11' is preferably collected into a container 63, placed immediately downstream with respect to the ejection station 60.

Preferably the activation mechanism 62 is driven by an electro-mechanical actuator, such as an electric motor.

The activation mechanism 62 can comprise a suitable kinematic chain 64 that transfers the rotation of said electric motor to the ejection roller 61.

In a preferred embodiment, the ejection roller 61 and at least a part of the activation mechanism 62 are mounted on a movable plate 65, pivoted to the frame 2 of the printer 1. The movable plate 65 can be driven between a lower position, wherein it is in contact with the card 11' so as to move the same, and an upper position, wherein it allows the card 11' to reach the ejection station 60 after the printing operation.

The invention achieves important advantages.

A first advantage is that the printer according to the present invention is capable of printing on cards obtaining high quality results, i.e. cards on which the printed ink remains for a long time and is not easily removed by accidental hits or scrapes.

Another advantage of the present invention is that the printer can print quickly while obtaining a high quality result.

Another advantage of the present invention is that the printer has a simple and not expensive structure.

Another advantage of the present invention is that the printer presents limited overall dimensions.

In the Printer according to the invention, the cards 11 have a substantially plate-like shape, having a substantially rectangular shape in a plant view, said rectangular shape having a larger side and a smaller side.

Said larger side has a length comprised between 80 mm and 90 mm.

Said smaller side has a length comprised between 50 mm and 60 mm.

Said plate-like shape has a thickness comprised between 0.4 mm and 0.8 mm.

In the Printer according to the invention, the auxiliary solvent has a boiling temperature higher than 120° C. and preferably higher than 150° C. Said auxiliary solvent is able to dissolve or to swell the plastic materials.

In the Printer according to the invention, the auxiliary the heating system 42 comprises a heating element 43 that is kept in contact with said card 11' during the printing operation.

Said heating element 43 is a plate-like element 48.

Said heating element 43 has a shape, in a plant view, substantially equal to that of said card 11'.

Said heating element 43 comprises one or more resistors R1, R2, said control circuit 44 being connected to said one or more resistors R1, R2 for making an electrical current flow through said one or more resistors R1, R2 and heat said card 11'.

Said control circuit 44 comprises:

- a main sensor 45 adapted to detect a parameter representative of a temperature of said heating element 43;
- a control unit 46 connected to said main sensor 45 and to said heating element 43 for regulating the temperature of said heating element 43 depending on the parameter detected by said main sensor 45.

Said main sensor 45 is mounted on said heating element 45.

In the Printer according to the invention, auxiliary sensor 47 is mounted on said printing station 50.

Said printing station comprises a support plate 53 for said at least one printhead 51, said support plate 53 being oriented according to a direction transverse to a path P of said carriage 40;

Said auxiliary sensor 47 being mounted on said support bar 53 at a position of minimum distance from said path P.

In the Printer according to the invention, the plate-like element 48 has a first and a second surface 48*a*, 48*b* opposite to each other, the first surface 48*a* being in contact with said card 11', the plate-like element 48 being engaged with said suction system 70, said plate-like element 48 having one or more holes 49 for allowing said suction system 70 to act on said card 11'.

One or more of said one or more holes 49 is a through hole having a first portion 49*a* ending on said first surface 48*a*, and a second portion 49*b* ending on said second surface 48*b*, said first portion 49*a* having a cross-section, on a first plane substantially parallel to the planar extension of said plate-like element 48, that is larger than a cross-section, on a second plane parallel to said first plane, of said second portion 49*b*.

In the Printer according to the invention, the control module 15 is configured for driving said pre-heating element 14 between at least two operating conditions, in which said pre-heating element 14 is maintained at respective different temperatures.

In the Printer according to the invention, the auxiliary the main roller 21 is drivable in a first direction of rotation A1 for moving said first card 11*a* towards said carriage 40, and in a second direction of rotation A2 opposite to said first direction of rotation A1, said main roller 21 rotating in said second direction of rotation A2 defining said recovering system 29.

In the Printer according to the invention, the extraction station 20 further comprises an electro-mechanical actuator 21*a* operatively active on said main roller 21 for activating said main roller 21 in the first or in the second direction of rotation A1, A2.

Said extraction station 20 further comprises a processing unit 21*b* configured for commanding said electro-mechanical actuator 21*a* so as to drive said main roller 21 in said first or second direction of rotation A1, A2.

The invention claimed is:

1. An ink-jet printer for printing on a thermoplastic card comprising:

a support, which is movable over a rail system, that is configured to support the card as it moves through the ink-jet printer;

a printing station comprising at least one ink-jet printhead for printing on said card;

a reservoir coupled to said at least one ink-jet printhead and containing an ink, said ink comprising:

a medium consisting of a low-boiling organic solvent;

an auxiliary solvent consisting of a high-boiling organic solvent; and a coloring component soluble in said medium;

said support including a heating system with a plate-like heating element having a substantially same size at the card to heat the card during operation of said printing station; and a suction system, which is coupled to the plate-like heating element as the card moves through the ink-jet printer, to maintain contact between the card and said support.

2. The ink-jet printer according to claim 1, further comprising:

a storage zone to store one or more cards;

an extraction station adapted to extract the card in said storage zone;

wherein the support comprises a support carriage on which to place the card extracted by the extraction station, said support carriage adapted to bring said card to said printing station.

3. The ink-jet printer according claim 2, wherein said heating system comprises a plate-like heating element adapted to be kept in contact with said card during the printing operation.

4. The ink-jet printer according to claim 3, wherein said heating system further comprises a control circuit operatively associated with said heating element for controlling a temperature of said heating element.

5. The ink-jet printer according to claim 4, further comprising an auxiliary sensor, operatively arranged to detect a parameter representative of a temperature of said card and sending said parameter to said control circuit;

said control circuit being configured for regulating the temperature of said heating element depending on the parameter detected by said auxiliary sensor.

6. The ink-jet printer according to claim 5, wherein said auxiliary sensor comprises an infra-red sensor.

7. The ink-jet printer according to claim 3, wherein the suction system acts on said card to keep said card in contact with said plate-like heating element.

8. The ink-jet printer according to claim 7, further comprising a pressing device, adapted to press the card onto the plate-like heating element during activation of said suction system.

9. The ink-jet printer according to claim 2, wherein said one or more cards in said storage zone includes a plurality of cards which are ordered from a first card to a last card, the first card being the one that undergoes the action of said extraction station, wherein said storage zone includes a pre-heating device for heating at least said first card.

10. The ink-jet printer according to claim 9, wherein said pre-heating device comprises:

a plate-like pre-heating element adapted to contact said first card in said storage zone; and a control module for regulating the heating of said pre-heating element.

11. The ink-jet printer according to claim 9, wherein said extraction station comprises at least a main roller drivable in contact with said first card for moving said first card towards said carriage, said extraction station further comprising a recovering system for recovering a possible further card extracted together with said first card and placing again said further card on said pre-heating plate-like heating element.

12. The ink-jet printer according to claim 1, wherein said medium has a boiling temperature lower than 120° C.

13. The ink-jet printer according to claim 1, wherein said medium is selected from the group of alcohols.

14. The ink-jet printer according to claim 1 forming a combination with the thermoplastic card, wherein said thermoplastic card comprises a thermoplastic material selected from the group consisting of: polyvinylchloride; polyvinylchloride filled with mineral fillers; laminate polyvinylchloride; acrylonitrite butadiene styrene terpolymers; polyethylenterephtalate; polylacticacid.

15. A method for ink-jet printing on a thermoplastic card, comprising:

positioning the card to be printed on a movable support that supports the card as it moves over a rail system through an ink-jet printer;

suctioning the card to maintain contact between the card and the support while the card moves through the ink-jet printer;

providing a printing station comprising at least one ink-jet printhead for printing on said card, said at least one ink-jet printhead being coupled to a reservoir containing an ink comprising:

a medium consisting of a low-boiling organic solvent;

an auxiliary solvent consisting of a high-boiling organic solvent;

a coloring component soluble in said medium; and heating said card with a heating element having a substantially same size as the card while the card is moving through the ink-jet printer on the support during ink-jet printing.

16. An ink-jet printer for printing on a thermoplastic card comprising:

a support on which the thermoplastic card is placed during a printing operation;

a printing station comprising at least one ink-jet printhead for printing onto the thermoplastic card;

a reservoir coupled to said at least one ink-jet printhead and containing an ink;

a plate-like heating element arranged to heat the thermoplastic card during the printing operation, the plate-like heating element having a substantially same size as the thermoplastic card;

a sensor structured and arranged to detect a parameter representative of a temperature of the heating element during the printing operation; and an auxiliary sensor structured and arranged to detect a parameter representative of a temperature of the thermoplastic card during the printing operation.

17. The ink-jet printer according to claim 16, further comprising a vacuum system coupled to the support that is operable to maintain contact between the card and the support as the card is moved through the ink-jet printer.

* * * * *